US007740335B2

(12) United States Patent
Miyamoto

(10) Patent No.: US 7,740,335 B2
(45) Date of Patent: Jun. 22, 2010

(54) LIQUID EJECTION APPARATUS AND MAINTENANCE METHOD OF LIQUID EJECTION HEAD

(75) Inventor: Fujio Miyamoto, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 807 days.

(21) Appl. No.: 11/703,006

(22) Filed: Feb. 6, 2007

(65) Prior Publication Data

US 2007/0188545 A1 Aug. 16, 2007

(30) Foreign Application Priority Data

Feb. 14, 2006 (JP) ..... 2006-037036

(51) Int. Cl.
*B41J 2/165* (2006.01)

(52) U.S. Cl. ..... 347/33

(58) Field of Classification Search ..... 347/22, 347/33

See application file for complete search history.

(56) References Cited

U.S. PATENT DOCUMENTS 6,511,150 B1 * 1/2003 Yoda et al. ..... 347/23
6,916,080 B2 * 7/2005 Okamoto ..... 347/29

FOREIGN PATENT DOCUMENTS

| | | | |
|---|---|---|---|
| JP | 10-291324 | A | 11/1998 |
| JP | 2000-343719 | A | 12/2000 |
| JP | 2001-277526 | A | 10/2001 |
| JP | 2001-347675 | A | 12/2001 |
| JP | 2005-205640 | A | 8/2005 |
| JP | 2005-238643 | A | 9/2005 |

* cited by examiner

*Primary Examiner*—An H Do
(74) *Attorney, Agent, or Firm*—Frishauf, Holtz, Goodman & Chick, P.C.

(57) ABSTRACT

A liquid ejection apparatus includes a plurality of liquid ejection heads, a plurality of elastic wiper blades for rubbing the nozzle formed surfaces of the liquid ejection heads, a blade cleaner for removing liquid adhered to the wiper blade, a cleaning unit for removing liquid adhered to the wiper blades, a wiper blade moving unit for respectively and independently moving the plurality of wiper blades between a rubbing position and a retreating position, and a control unit that controls the wiper blade moving unit so that the cleaning unit can make the blade cleaner and the moved wiper blades rub with each other. Herein, it is possible to maintain cleaning performance, preventing contamination of a wiper blade caused by liquid splashed from a neighboring wiper blade.

14 Claims, 10 Drawing Sheets

FIG. 8 ( a )
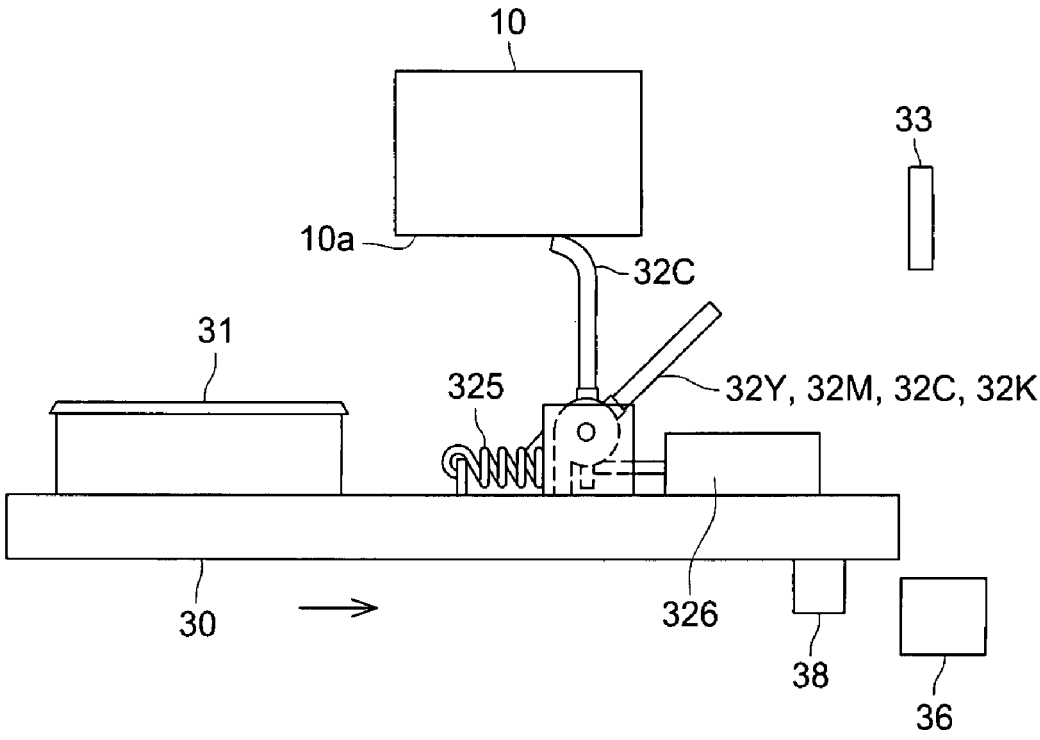
FIG. 8 ( b )
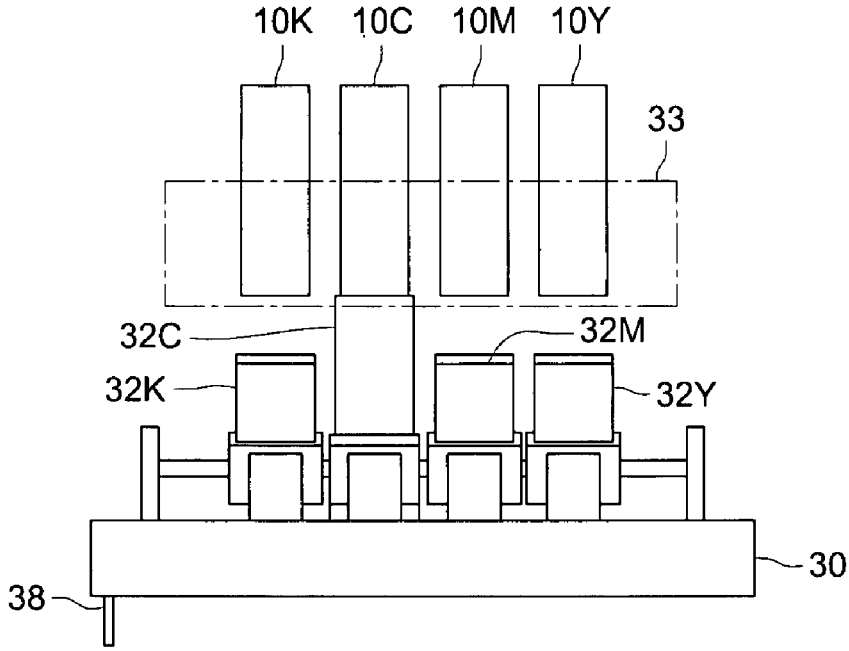

FIG. 9 ( a )
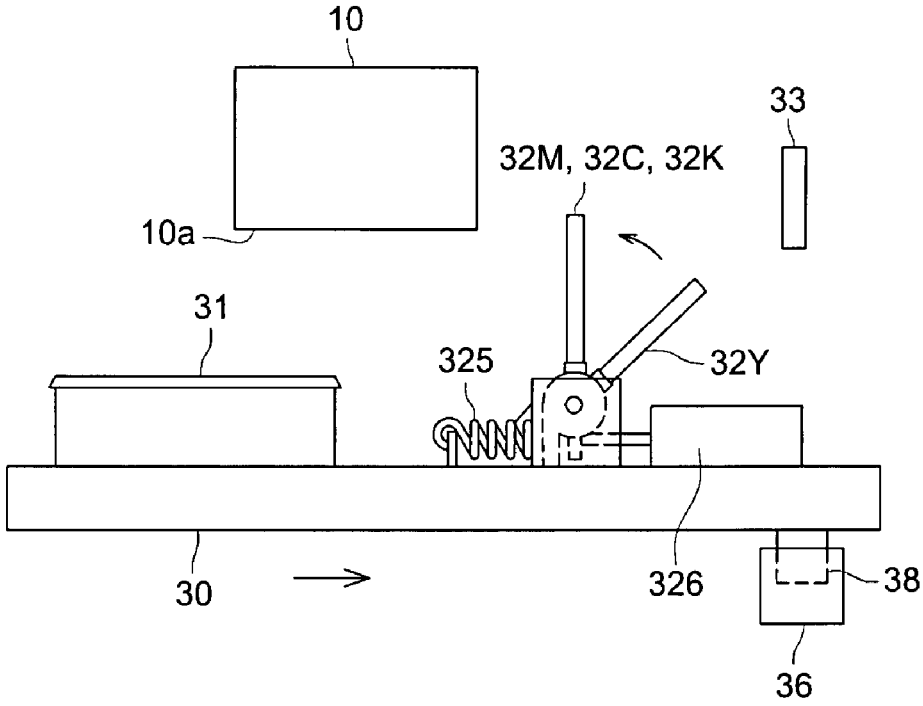
FIG. 9 ( b )
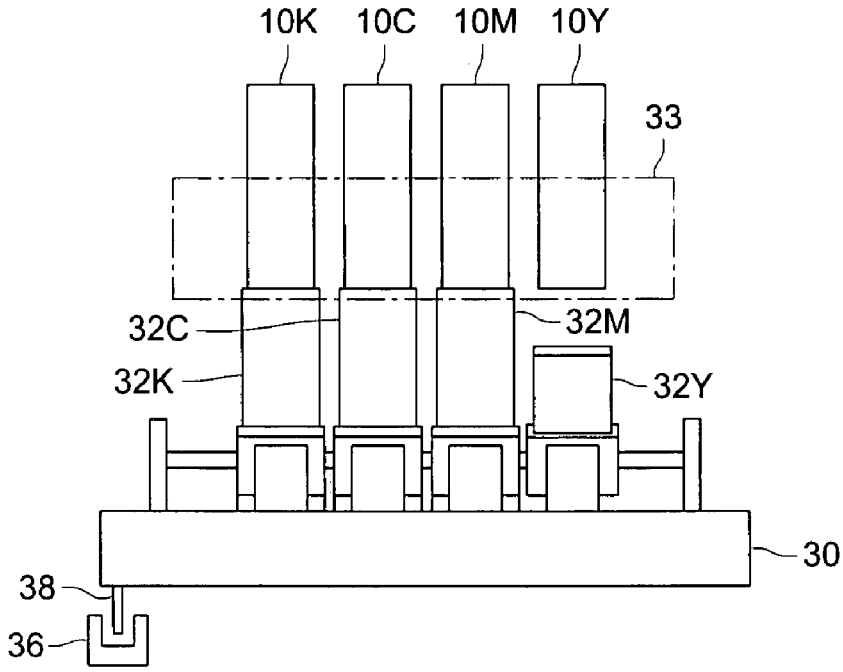

FIG. 10 ( a )
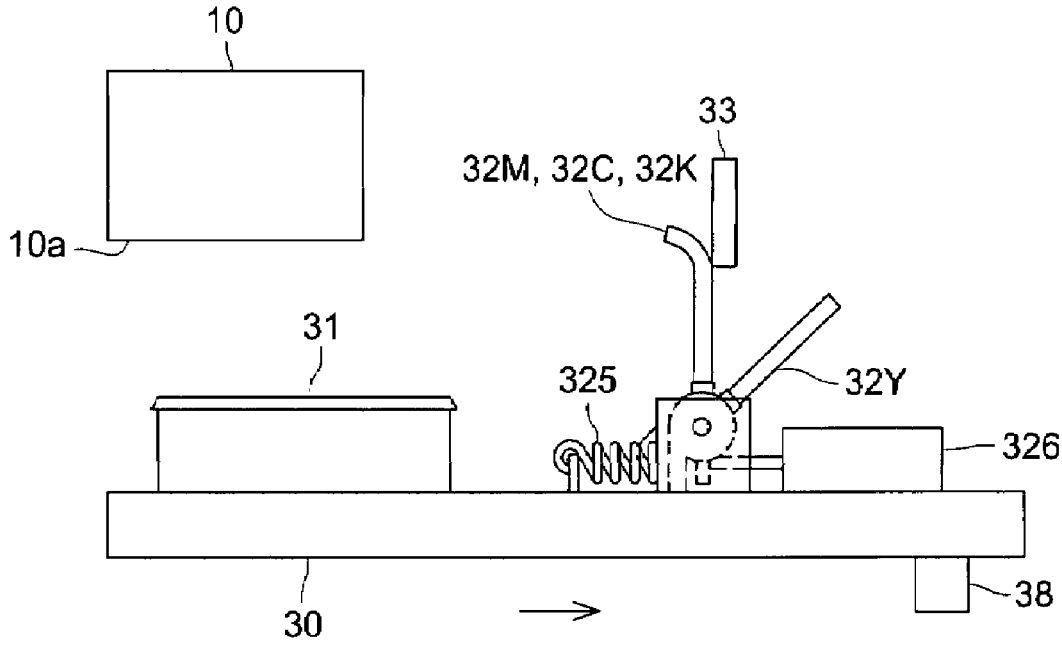
FIG. 10 ( b )
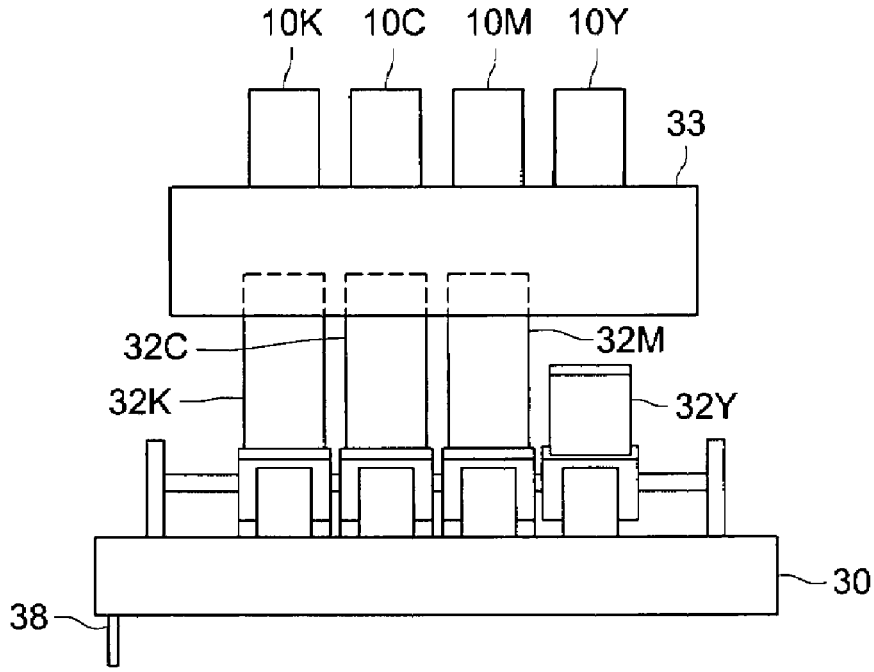

LIQUID EJECTION APPARATUS AND MAINTENANCE METHOD OF LIQUID EJECTION HEAD

This application is based on Japanese Patent Application No. 2006-037036 filed on Feb. 14, 2006 in Japanese Patent Office, the entire content of which is hereby incorporated by reference.

FIELD OF THE INVENTION

The present invention relates to a liquid ejection apparatus and a maintenance method of a liquid ejection head, and particularly relates to a liquid ejection apparatus that cleans off liquid adhered to wiper blades having rubbed nozzle formed surfaces and a maintenance method of liquid ejection heads thereof.

BACKGROUND OF THE INVENTION

As liquid ejection devices having a liquid ejection head that can eject liquid in a droplet state, there are offered, for example, image recording devices that record an image or the like on a recording medium by ejecting ink droplets, electrode forming devices that form an electrode by ejecting electrode material in a liquid state onto a substrate, biochip manufacturing devices that manufacture a biochip by ejecting living specimen, and micropipettes that eject a sample in a predetermined amount into a reservoir.

This type of liquid ejecting devices reserves ejecting liquid in a reservoir, then supplies the liquid to a liquid ejection head, and ejects the liquid, to which a pressure has been applied in a pressure generating chamber in the liquid ejection head, from a nozzle as droplets toward an object. Herein, there are cases where when the droplets land on the object, splashes adhere to the surface having nozzles (hereinafter, referred to as a nozzle formed surface) and contaminate the surface.

Further, there are also cases where when liquid is ejected from nozzles, finer droplets (satellites) are generated, separating from droplets that land on an object. The satellites may not reach the object and may hang in the air to adhere to the nozzle formed surface.

Still further, there are cases where droplets remain adjacent to nozzles, when the nozzle formed surface is sealed with a cap member and a negative pressure from a suction pump is applied to forcibly suck and discharge liquid from the nozzles so that clogging of the nozzles are resolved.

If a nozzle formed surface of a liquid ejection head, particularly the peripheral of the nozzles, is contaminated in such a manner, it is possible that the ejecting direction of droplets is deviated from a normal direction or the nozzles are clogged to be disabled to eject droplets, which may affect ejection of droplets.

In order to solve these problems, some liquid ejection devices of this type are provided with a wiping mechanism to wipe off contaminants adhered to the nozzle formed surface. Such a wiping mechanism is provided with a wiper blade in a plate form (reed shape) of an elastic material, for example, rubber or elastomer, and is disposed on the home position side which is the waiting area of the liquid ejection head in the liquid ejection device. This wiper blase is located in a normal state at a retreating position where the wiper blade does not contact the liquid ejection head, and at the time of wiping, the upper portion of the wiper blade moves to a wiping position where the wiper blade can contact the nozzle formed surface of the liquid ejection head. Then, when the wiper blade contacts the liquid ejection head, the entire blade is deformed into an arc shape, and the holding member for holding the wiper blade or the liquid ejection head moves, in a state where the front end of the blade contacts the nozzle formed surface. Thus, the nozzle formed surface is rubbed, and the contaminants adhered to the nozzle formed surface are wiped off by the wiper blade.

The liquid having been rubbed off from the nozzle formed surface is adhered to the wiper blade having rubbed the nozzle formed surface of the liquid ejection head. If this state is left, the liquid adhered to the wiper blade adheres to the nozzle formed surface in return during the next wiping operation, which contaminates the nozzle formed surface on the contrary, causing problems such as nozzle failure or deviation of ejection.

In this situation, a device in a prior art has been offered which removes liquid adhered to a wiper blade having rubbed a nozzle formed surface, by rubbing the wiper blade with a blade cleaner, so as to maintain the cleaning performance.

For example, in Patent Document 1 (Japanese Patent Publication TOKKAI No. H10-291324), disclosed is a technology in which a blade cleaner is made contact with a blade strong elastically without rotation during forward motion, and is made contact with the blade light elastically with rotation during backward motion.

In Patent Document 2 (Japanese Patent Publication TOKKAI No. 2000-343719), disclosed is a technology in which wiping operation is performed only on nozzle arrays that need wiping operation.

In Patent Document 3 (Japanese Patent Publication TOKKAI No. 2001-277526), disclosed is a technology in which a rotary type of a blade for cleaning the nozzle formed surface of a recording head by wiping is provided.

In Patent Document 4 (Japanese Patent Publication TOKKAI No. 2001-347675), disclosed is a technology in which mixing of colors of respective inks due to splashed ink is prevented by disposing a division plate between heads during wiping.

In Patent Document 5 (Japanese Patent Publication TOKKAI No. 2005-205640), disclosed is a technology in which a wiper blade and scraper rub each other during forward motion, and the scraper retreats from the wiper blade during backward motion.

In Patent Document 6 (Japanese Patent Publication TOKKAI No. 2005-238643), disclosed is a technology in which mixing of colors is prevented by providing notched portions for division between scrapers for respective colors.

For example, in a case of a full-color inkjet recording device that is a liquid droplet ejection device using liquid ejection heads, a recording head for ejection of K (black) ink and recording heads for ejection of respective color inks, such as Y (yellow), C (cyan), M (magenta), or the like, namely plural recording heads, are mounted on the device.

Further, sometimes, ink is sucked selectively only from heads with which ejection failure, such as nozzle failure or deviation of ejection, has occurred, for a smaller amount of ink waste during suction of ink. Herein, preferably, only the heads from which ink has been sucked are selectively wiped with a wiper blade. It is because, through wiping heads from which ink has not been sucked (hereinafter, also referred to as null wiping), the wiper blade may drag foreign matter to damage the heads or wiping itself may cause nozzle failure. Further, the wiper blade may be worn, which significantly shortens the life of the wiper blade.

A lot of ink is adhered to a wiper blade having wiped a head from which ink had been sucked. In this situation, if ink is removed by rubbing the wiper blade, which have wiped, with a blade cleaner, as in a prior art, then ink from the wiper blade having wiped splashes and adheres to neighboring wiper blades, causing mixing of colors and ejection failure.

In order to solve this problem, a wiper blade may be fallen to the side opposite to the moving direction (rubbing direction) during wiping. However, with such a structure, a large force is applied to means for holding the wiper blade during wiping, which may suddenly fall the wiper blade, disabling enough wiping. In order to solve this problem, it is necessary to lock the wiper blade during wiping, causing a problem of making the mechanical structure complicated.

With this background, an object of the present invention is to provide a liquid ejection apparatus and maintenance method of liquid ejection heads, wherein it is possible to maintain cleaning performance, preventing contamination of a wiper blade caused by liquid splashed from a neighboring wiper blade. Herein, prior to the splashing of the liquid, liquid had been adhered to the neighboring wiper blade following selective rubbing of a nozzle surface by the neighboring blade and has been removed from the neighboring blade by rubbing with a blade cleaner.

Other objects of the invention will be made apparent by the following description.

SUMMARY OF THE INVENTION

Problems, as described above, are solved in aspects of the invention including the followings.

In a first aspect of the invention, there is provided a liquid ejection apparatus, including:

a plurality of liquid ejection heads each of which ejects a liquid droplet from a nozzle;

a plurality of elastic wiper blades each of which contacts a nozzle formed surface of the corresponding liquid ejection head and moves in substantially parallel and relatively to the nozzle formed surface of the liquid ejection head so as to rub the nozzle formed surface;

a blade cleaner for removing liquid adhered to the wiper blades;

a cleaning unit for removing liquid adhered to the wiper blades by relatively moving the wiper blades and blade cleaner to be rubbed with each other;

a wiper blade moving unit for respectively and independently moving the plurality of wiper blades between a rubbing position where the wiper blades can rub the nozzle formed surfaces of the respective liquid ejection heads and a retreating position where the wiper blades do not contact the respective liquid ejection heads; and a control unit that controls the wiper blade moving unit such that, after the control unit has moved a wiper blade selecting from the plurality of wiper blades to the rubbing position and rubbed the nozzle formed surface of the corresponding liquid ejection head with the wiper blade, the control unit moves at least one other wiper blade in addition to the selected wiper blade, to the rubbing position so that the cleaning unit can make the blade cleaner and the moved wiper blades rub with each other.

In a second aspect of the invention, there is provided a maintenance method of liquid ejection heads of a liquid ejection apparatus having a plurality of liquid ejection heads, a plurality of corresponding elastic wiper blades, and a wiper cleaner for cleaning the wiper blades, including the steps of:

moving a first wiper blade of which a corresponding liquid ejection head having ejected a liquid droplet from a nozzle with a selection from the plurality of wiper blades, from a retreating position where the wiper blades do not contact nozzle formed surfaces of the corresponding liquid ejection heads to a rubbing position where the wiper blades can rub the nozzle formed surfaces, thereby making the first wiper blade contact the nozzle formed surface, and moving the first wiper blade in substantially parallel and relatively to the nozzle formed surface so as to rub the nozzle formed surface with the first wiper blade;

independently moving at least one wiper blade other than the first selected wiper blade of the plurality of wiper blades from the retreating position to the rubbing position, after the rubbing of the nozzle formed surface of the liquid ejection head with the first selected wiper blade; and removing liquid adhered to the wiper blades having been moved to the rubbing position, by relatively moving the wiper blades and the blade cleaner to be rubbed with each other.

BRIEF DESCRIPTION OF THE DRAWINGS

FIGS. 7*a* to 10*b* are diagrams showing wiping operation.

DETAIL DESCRIPTION OF THE PREFERRED EMBODIMENT

Figure 1:
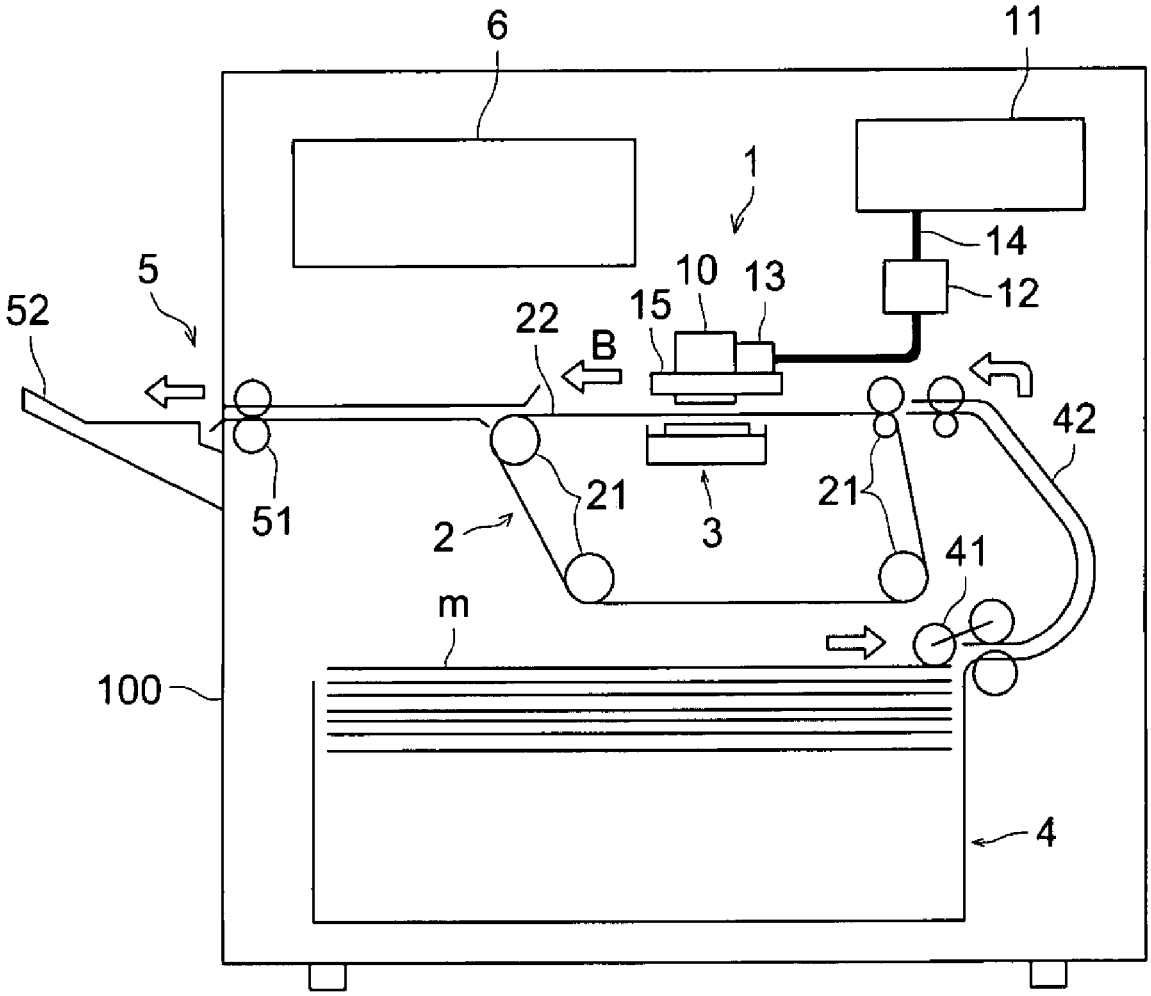
FIG. 1 is a schematic diagram showing the inner structure of an inkjet printer, which is an example of a liquid ejection apparatus in accordance with the invention.

A preferred embodiment in accordance with the present invention will be described, referring to the drawings.

FIG. 1 is a schematic diagram showing the inner structure of an inkjet printer, which is an example of a liquid ejection apparatus in accordance with the invention.

As shown in FIG. 1, a recording section 1, conveying mechanism 2, maintenance section 3, sheet feeding section 4, sheet ejection section 5, and control section 6 are housed in a housing 100.

The sheet feeding section 4 storing recording medium m is disposed in a lower part of the housing 100, and the recording medium m is conveyed by a sheet feeding roller 41 toward the recording section 1 through a conveying path 42.

The recording section 1 includes recording heads 10 which are liquid ejection heads for ejecting inks in plural colors onto the recording medium m. Each recording head 10 is supplied with ink from a respective ink tank 11 by an ink supply tube 14 via an intermediate tank 12 and damper 13.

The conveying mechanism 2 is disposed below the recording section 1. The conveying mechanism 2 is structured with four rollers 21 and an endless belt 22 wound around the rollers 21. Herein, a driving unit, not shown, rotationally drives one of the rollers 21, and thus the endless belt 22 is driven rotationally and intermittently by a predetermined conveying amount each time along the arrow direction B (sub-scanning direction), shown in FIG. 1. In such a manner, a recording medium m conveyed from the conveying path 42 and loaded on the endless belt 22 is conveyed along the sub-scanning section by the predetermined conveying amount.

The maintenance section 3 is arranged to perform maintenance operations of the recording heads 10, such as ink sucking operation and wiping operation, and is disposed at a home position, beside the conveying mechanism 2, where a carriage 15 is kept waiting.

The recording medium m on which a certain image has been recorded by the recording section 1 is conveyed by the conveying mechanism 2 toward the sheet ejection section 5, and is ejected by a pair of sheet ejection rollers 51 to a sheet ejection tray 52 installed outside the housing 100.

The control section 6 controls respective operations in the inkjet printer, such as image recording and maintenance.

Figure 2:
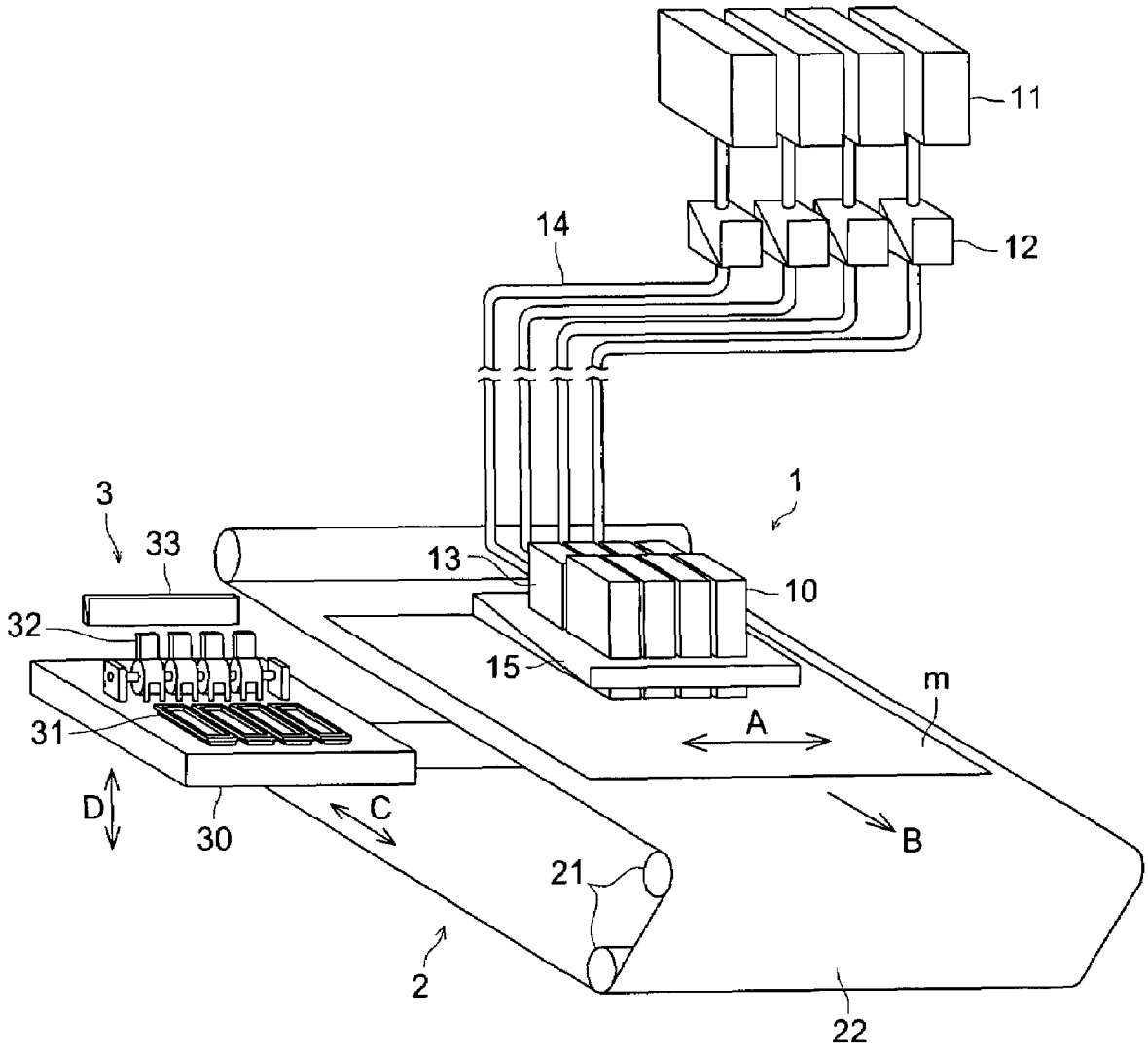
FIG. 2 is a perspective view of a main part of the inkjet printer shown in FIG. 1.

FIG. 2 is a perspective view of a main part of the inkjet printer shown in FIG. 1.

The recording heads 10 are a plurality of recording heads for ejecting inks in plural colors (Herein, four recording heads are shown, corresponding to the inks of Y, M, C, and K. However, the number of recording heads is not limited at all thereto.). The recording heads 10 are mounted on the common carriage 15, together with dampers 13 provided corresponding to the respective recording heads 10.

Each recording head 10 is provided with an array of a number of nozzles along the sub-scanning direction, at the surface (nozzle formed surface) facing an endless belt 22 of the conveying mechanism 2, and ejects ink from these nozzles as tiny droplets toward the surface of the recording medium m located below the nozzles.

Figure 6:
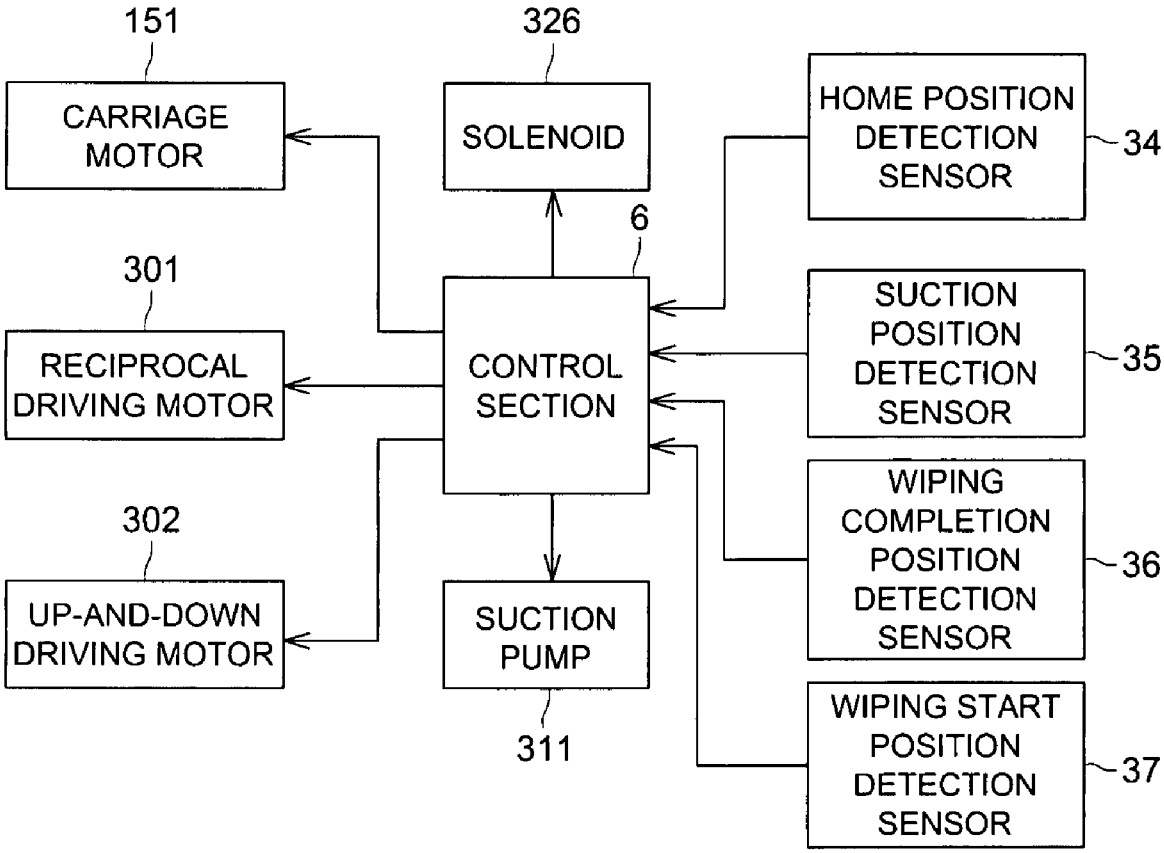
FIG. 6 is a block diagram showing a control structure related to maintenance.

The carriage 15 is arranged along the arrow direction A (main-scanning direction), shown in FIG. 2, perpendicular to the sub-scanning direction, to be movable horizontally and reciprocally, driven by a carriage motor 151 (see FIG. 6). In such a manner, the recording heads 10 are reciprocally movable along the main-scanning direction above the conveying mechanism 2.

The ink tanks 11 and the intermediate tanks 12 correspond to the respective recording heads 10, and the ink supply tubes 14 communicate with them.

A certain image is recorded on the recording medium m at the recording section 1 through a reciprocal motion of the carriage 15 along the main-scanning direction, by collaboration between ejection operation for ejecting ink droplets from the respective nozzles of the recording heads 10 onto the recording medium m corresponding to image data and conveying operation for conveying the recording medium m by the conveying mechanism 2 along the sub-scanning direction intermittently by the predetermined conveying amount at a time.

The maintenance section 3 is located at one side of the conveying mechanism 2. The maintenance section 3 is provided with a base table 30 on which suction caps 31 and wiper blades 32 (32Y, 32M, 32C, and 32K) are mounted, corresponding to the respective recording heads 10. The base table 30 is arranged to be horizontally and reciprocally movable along the arrow direction C, shown in FIG. 2, in substantially parallel to the sub-scanning direction, driven by a reciprocal driving motor 301 (see FIG. 6). The base table 30 is arranged also to be ascendable and descendible along the arrow D direction, which is vertical.

Further, a blade cleaner 33 is disposed above one end side of the base table 30, so as to remove ink adhered to the respective wiper blades 32 by rubbing them.

Figure 3:
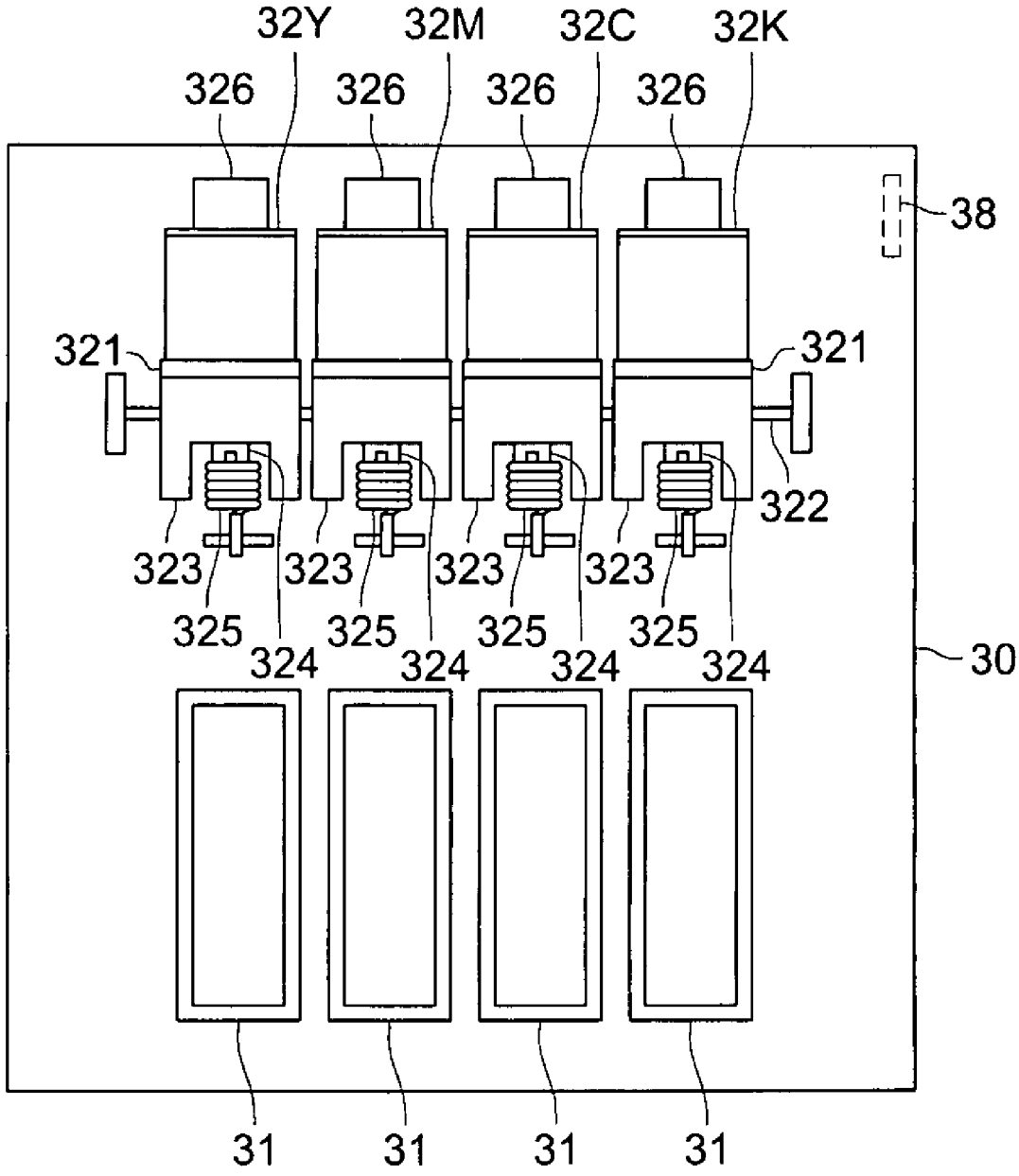
FIG. 3 is a plan view of a base table.
Figure 4:
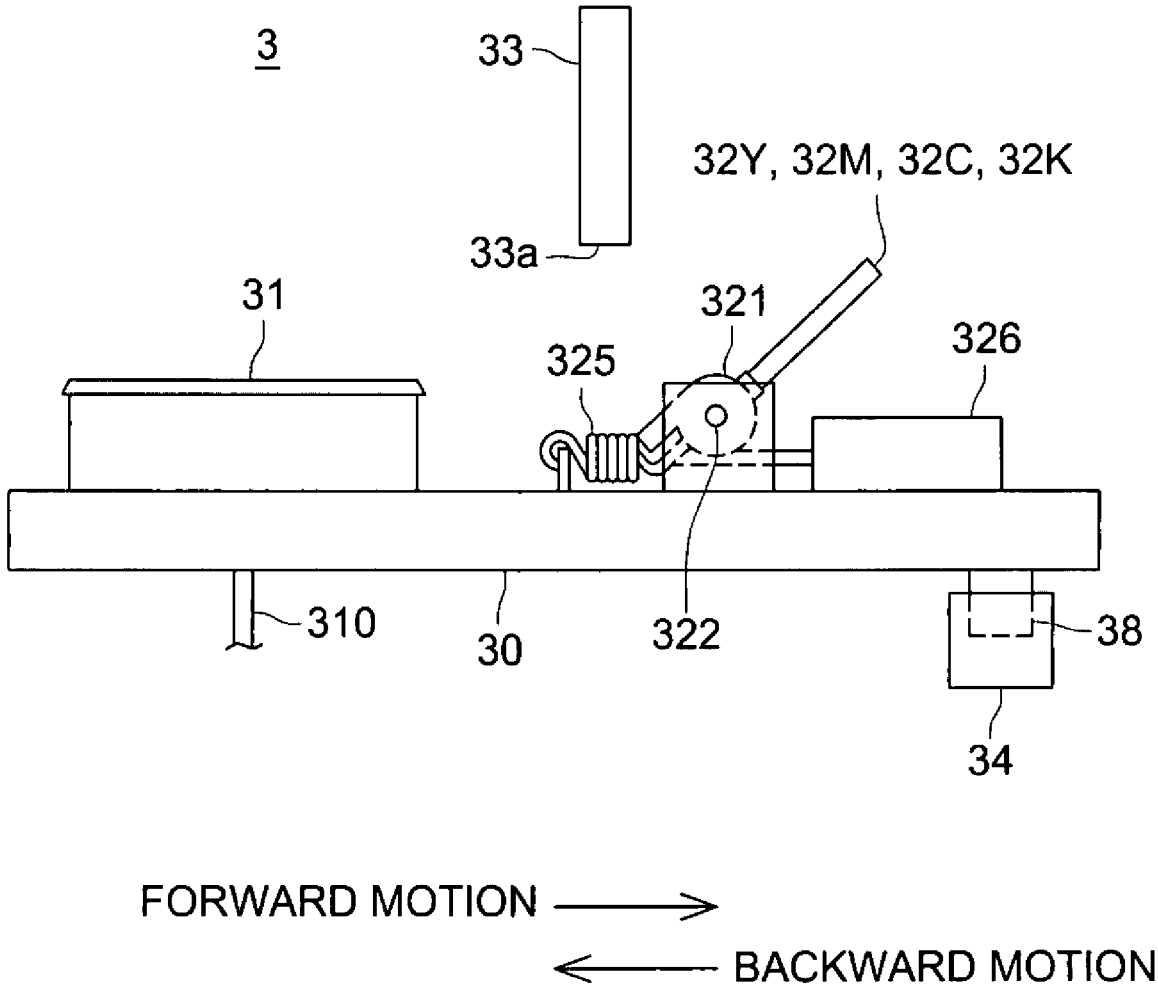
FIG. 4 is a side view of a maintenance section.
Figure 5:
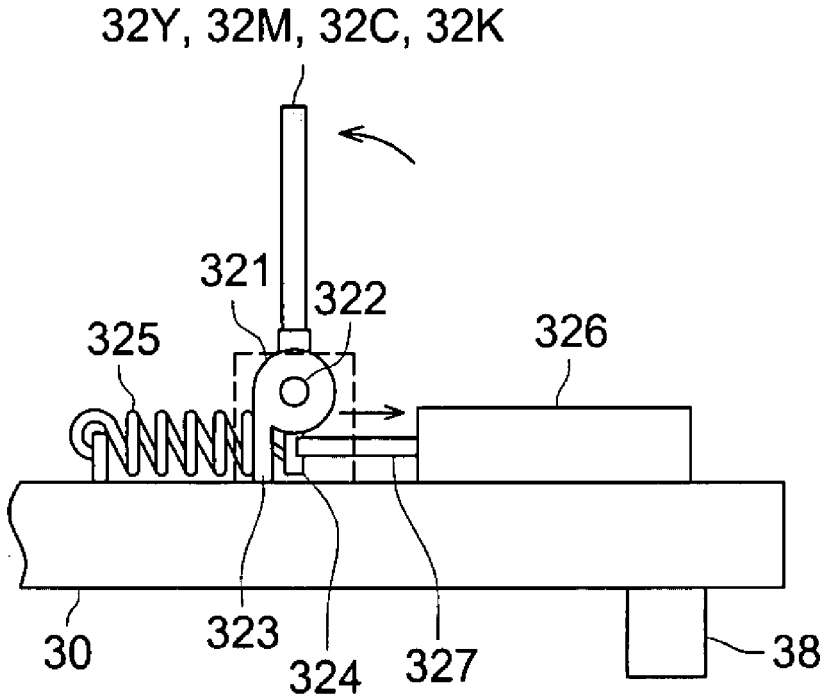
FIG. 5*a* is a diagram showing a state where a wiper blade is oscillated to a rubbing position.
FIG. 5*b* is a diagram showing a state where the wiper blade is oscillated to a retreating position.
Figure 5:
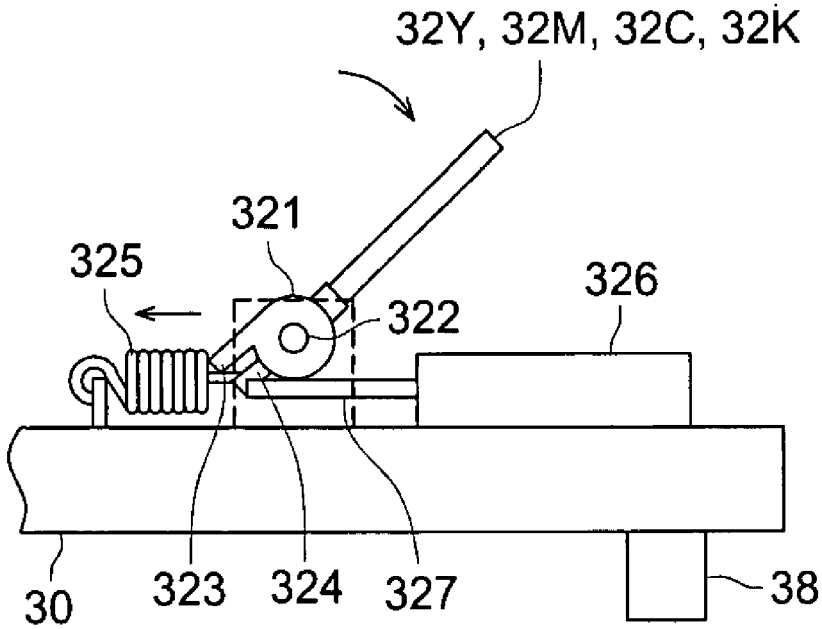

The maintenance section 3 will be described in further detail. FIG. 3 is a plan view of the base table; FIG. 4 is a side view of the maintenance section; FIGS. 5*a* and 5*b* are illustrations of the operation of a wiper blade; and FIG. 6 is a block diagram showing a control structure related to the maintenance.

The suction caps 31 tightly contact the nozzle formed surfaces of the respective recording heads 10, thus forcibly suck ink from the corresponding recording heads 10 so as to fix problems, such as clogging of nozzles. The suction caps 31 are formed in a reservoir shape having an opening in substantially the same shape as the nozzle surfaces of the recording heads 10, and disposed at one end portion on the base table 30. The inside of each suction cap 31 communicates with a suction pump 311 (see FIG. 6) through a suction tube 310, and the suction pump 311 is driven to suck air in the suction cap 31 through the suction tube 310.

Each wiper blade 32 is a member for wiping and removing ink adhered to a nozzle formed surface such that the wiper blade 32 elastically contacts the nozzle formed surface of a corresponding recording head 10 and rubs the nozzle formed surface as the base table 30 moves during wiping. Each wiper blade 32 is formed of an elastic material, such as rubber, in a plate shape.

The base end side of each wiper blade 32 is individually supported by a wiper blade supporting section 321. The wiper blade supporting sections 321 are installed independently from each other and rotatably, around a common shaft 322 disposed on the base table 30 and sub in substantially parallel to the main scanning direction.

At each wiper blade supporting section 321, a stopper section 323 in a two-fork shape is protrudingly provided on the side opposite to the fitting side of the wiper blade 32, with the shaft 322 therebetween, such that the tip end of the wiper blade supporting section 321 contacts the base table 30 when the wiper blade 32 is in a standing state substantially vertical to the base table 30 (refer to FIG. 5*a*). In such a manner, the stopper section 323 restricts the range of the rotation motion of the wiper blade 32 on the suction cap 31 side (the direction opposite to the rubbing direction) around the shaft 322 of the wiper blade supporting section 321, up to the position where the wiper blade 32 becomes upright.

Further, at each wiper blade supporting section 321, one oscillation operation section 324 is protrudingly disposed between the two folks of the stopper section 323, on the side opposite to the fitting side of the wiper blade 32, with the shaft 322 therebetween. On the side, facing the suction cap 31, of each oscillation operation section 324, one end of a tension spring 325 (the second moving means) is fitted, of which the other one end is fixed on the base table 30. On the side, opposite to the suction cap 31, of the oscillation operation section 324, an operation lever 327 of a solenoid 326 (the first moving means) provided on the base table 30 is fitted.

No current is applied to a solenoid 326 during normal time, such as non-maintenance time, and the solenoid 326 operates when current is applied to it, so as to pull back the operation lever 327 toward the solenoid 26. During this operation, the oscillation operation section 324 is rotationally pulled around the shaft 322 to the solenoid 326 side against the urging pulling force by the tension spring 325 so that the wiper blade supporting section 321 rotates until the tip end of the stopper section 323 contacts the surface of the base table 30, and thereby the wiper blade 32 is oscillated toward the suction cap 31 side (FIG. 5*a*).

On the other hand, when no current is applied to the solenoid 326, the suction force of the operation lever 327 is released. Accordingly, the oscillation operation section 324 is pulled by the pulling force of the tension spring 325 so that the wiper blade supporting section 321 rotates around the shaft 322 toward the solenoid 326 side, and thus the wiper blade 32 is oscillated, inclining down toward the solenoid 326 side (FIG. 5*b*).

As to whether current is to be applied or not to the respective each solenoids 326 is controlled by the control section 6, independently from the other solenoids 326. Accordingly, each wiper blade 32 is independently movable between the upright state (FIG. 5*s*) and inclining state (FIG. 5*b*).

Figure 7:
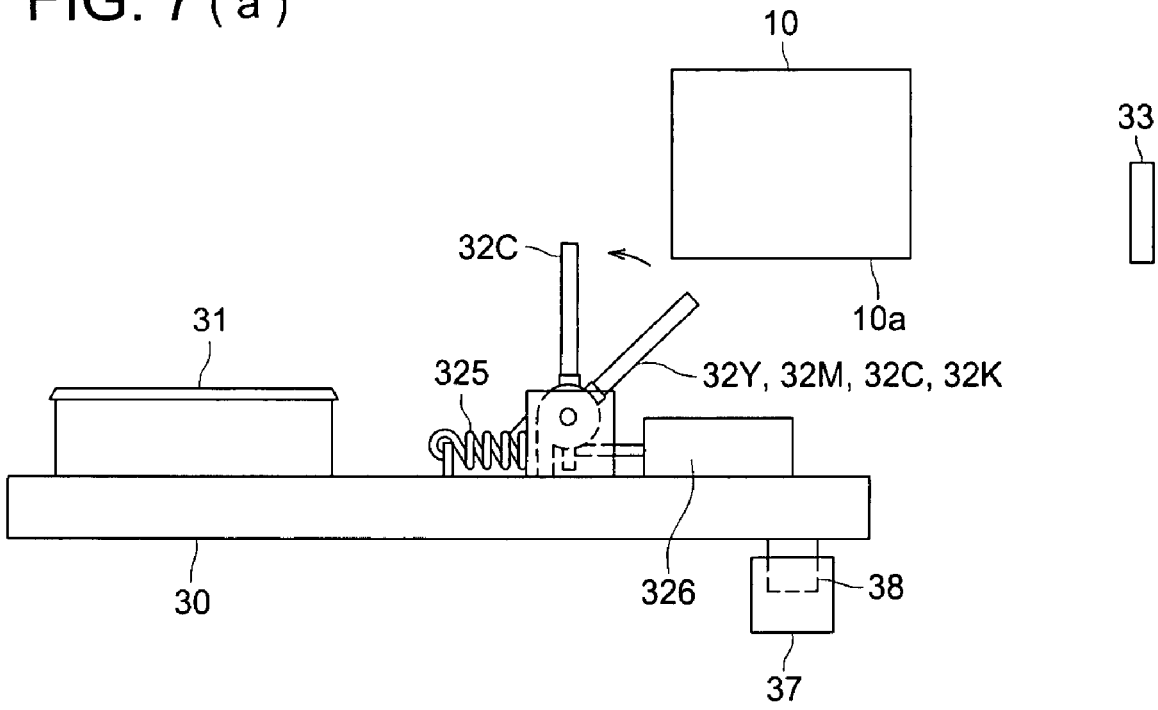
Figure 7:
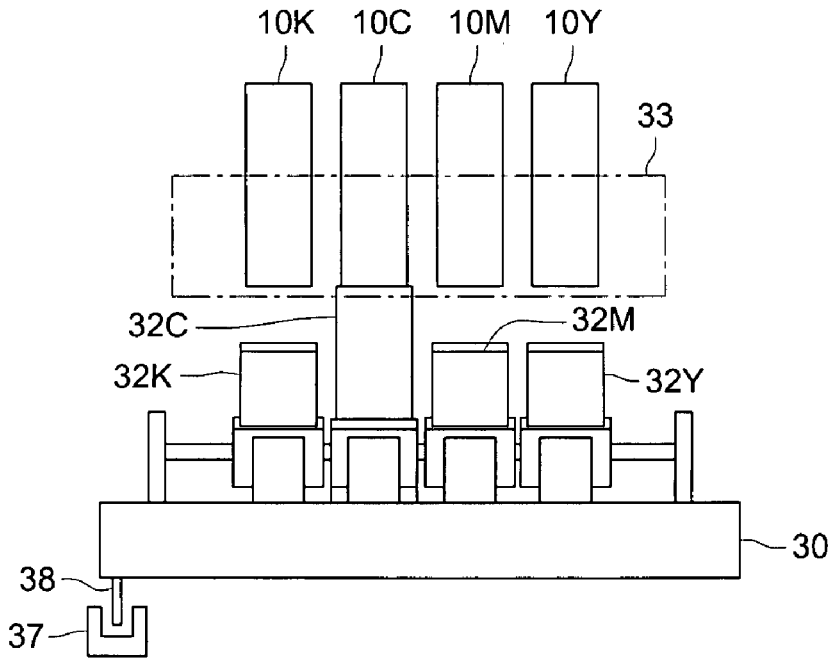

Each wiper blade 32 is arranged such that the tip end of the wiper blade 32 is located at a higher position than the nozzle formed surface 10*a* of the corresponding recording head 10*a* (see FIG. 7*a*) when the wiper blade 32 is in the upright state. This state locates the wiper blade 32 at a rubbing position allowing the wiper blade 32 to contact the nozzle formed surface 10*a*. In the inclining-down state, the tip end of the wiper blade 32 is located at a lower position than the nozzle formed surface 10*a*. This state locates the wiper blade 32 at a retreating position where the wiper blade 32 does not contact the nozzle formed surface 10*a*.

FIGS. 3 and 4 show a state where the maintenance section is at the home position and the wiper blades 32 are waiting at the retreating position.

The blade cleaner 33 is a member for rubbing off ink which has adhered to the tip end of a wiper blade 32 after rubbing the nozzle formed surface. The blade cleaner 33 is formed in a plate shape in a length covering all the wiper blades 32.

In order that the tip end of the blade cleaner 33 can contact the tip end of a wiper blade 32 when the wiper blade 32 is upright and located at the rubbing position, the blade cleaner 33 is disposed such that the bottom end 33*a* is located at a position lower than the tip end of a wiper blade 32 that is at the rubbing position.

While the base table 30 is provided such that the table 30 can be reciprocally moved by a reciprocal driving motor 301, the blade cleaner 33 does not move in a reciprocal motion direction unlike the base table 30, and is disposed on the forward side, which is in the direction the base table 30 moves away from the recording heads 10 further than the position to which a wiper blade 32 moves separating from the recording head 10 to elastically return to the upright state after rubbing the nozzle formed surface.

Below the base table 30 and along the moving path of the base table 30, there are disposed a home position detection sensor 34, suction position detection sensor 35, wiping completion position detection sensor 36, and wiping start position detection sensor 37 in this order (see FIG. 6). In each of the sensors 34 to 37, a light emitting section and light receiving section are disposed facing each other, wherein the light receiving section detects the change in light intensity projected from the light emitting section toward the light receiving section. Only the home position detection sensor 34 is shown in FIG. 4.

On the other hand, on the bottom surface of the base table 30, a shielding plate 38 is protrudingly provided and passes between the light emitting sections and light receiving sections of the respective sensors 34 to 37, when the base table 30 moves reciprocally. In this situation, light emitted from a light emitting section is shielded by the shielding plate 38, and thus the light intensity received by a light receiving section drops, thereby enabling detection of the position of the base table 30.

The home position detection sensor 34 detects the fact that the base table 30 has come to the home position. The home position detection sensor 34 is located at a position to detect the shielding plate 38 when the base table 30 has moved forward and the tip end of a wiper blade 32 located at the rubbing position has come to the position where the tip end of a wiper blade 32 has passed the blade cleaner 33 after rubbing it.

The suction position detection sensor 35 detects the position where the suction caps 31 suck the recording heads 10. The suction position detection sensor 35 is located at a position to detect the shielding plate 38 when the base table 30 located at the home position has moved backward and the respective suction caps 31 on the base table 30 have come to the position just below the respective recording heads which are waiting at the home position.

The wiping completion position detection sensor 36 detects rubbing completion of the nozzle formed surface of a recording head 10 by a wiper blade 32. The wiping completion position detection sensor 36 is located at a position to detect the shielding plate 38 when the base table 30 has moved forward and the wiper blade 32 has separated from the nozzle formed surface and has come to the position where the wiper blade 32 has returned to upright state.

The wiping start position detection sensor 37 detects the position to start rubbing the nozzle formed surface of a recording head 10 with a wiper bade 32. The wiping start position detection sensor 37 is located at a position to detect the shielding plate 38, after ink sucking operation, or when the base table 30 has moved backward from the home position, the wiper blades 32 have passed under the recording heads 10, and the base table 30 has come to the position where a wiper blade 32 does not interfere with a recording head 10 even if the wiper blade 32 is moved to the rubbing position.

Next, maintenance operation of the recording heads by the maintenance section 3 will be described. FIGS. 7*a* to 10*b* show wiping operation. In FIGS. 7*a*, 8*a*, 9*a* and 10*a*, the maintenance section 3 is viewed from side. In FIGS. 7*b*, 8*b*, 9*b* and 10*b*, the maintenance section 3 is viewed from the forward side.

In the maintenance operation, the control section 6 drives the carriage motor 151 to move the carriage 15 in the main scanning direction, and stops the carriage 15 at the home position of the carriage 15 where the maintenance section 3 is disposed. At the maintenance section 3, the control section 6 drives the reciprocal driving motor 301 to move the base table 30 from the home position in the forward direction, and stops the base table 30 at the position where the suction position detection sensor 35 has detected the shielding plate 38. At this moment, the respective solenoids 326 are still in a state of no current application, and accordingly, the respective wiper blades 32 are at the retreating position where the wiper blades 32 are inclined down by the pulling force of the tension springs 325.

Next, the control section 6 drives an up-and-down driving motor 302 to lift the base table 30 so that the suction caps 31 tightly contact with the nozzle formed surfaces 10*a* of the corresponding recording heads 10. Then, the control section 6 drives a suction pump 311 to suck air in the suction caps 31 that needs suction so that a negative pressure is generated in the suction caps 31 to suck ink from the recording heads 10 for recovery from nozzle clogging or the like. Sucked ink is discharged through suction tubes 310.

It will be assumed below that the recording head 10 from which ink has been sucked is the C (cyan) head 10*c*.

After sucking ink, the control section 6 lowers the base table 30 to return it into the original state, and subsequently starts wiping operation. In the wiping operation, the control section 6 moves the base table 30 further in the backward direction so that the wiper blade 32 moves further than the position below the recording head 10 to be out of the area below the recording head 10 while keeping the respective wiper blades 32 in the inclining-down state at the retreating position, and then stops the base table 30 at the position where the wiping start position detection sensor 37 has detected the shielding plate 38. Then, the control section 6 applies current to the corresponding one selected from the solenoids 326, and oscillates the wiper blade 32C corresponding to the recording head 10C having sucked ink, until the wiper blade 32*c* becomes upright at the rubbing position (FIGS. 7*a* and 7*b*).

If the control section 6 starts moving the base table 30 in the forward direction from this state, the tip end of the wiper blade 32C contacts the nozzle formed surface 10*a* of the corresponding recording head 10C. At this time, only the wiper blade 32C rubs the nozzle formed surface 10*a* while bowing on the side opposite to the moving direction due to the elasticity (FIGS. 8*a* and 8*b*). Accordingly, ink adhered to the nozzle formed surface 10*a* of the recording head 10C is wiped by the wiper blade 32C and removed from the nozzle formed surface 10*a*.

Further, at this time, the wiper blade 32C located at the rubbing position is restricted by the stopper 323 from rotating to the direction opposite to the rubbing direction. Thus, the wiper blade 32 is prevented from inclining down and is able to surely rub the nozzle formed surface 10*a*.

When the base table 30 is further moved in the forward direction, the tip end of the wiper blade 32C separates from the nozzle formed surface 10*a* in the course of the motion, and the wiping operation is completed. Upon the separation, the wiper blade 32C elastically returns into the upright state due to the restoring force of itself, and splashes ink adhered to the tip end thereof.

Herein, the wiping completion position detection sensor 36 detects the shielding plate 38 of the base table 30, and detects the fact that the base table 30 is located at the wiping completing position. Upon this detection, the control section 6 applies current to the solenoids 326 corresponding to the wiper blades 32M and 32K neighboring the wiper blade 32C having been used for wiping, and oscillates the wiper blades 32M and 32K to the rubbing position where the blades turn into the upright state (FIGS. 9*a* and 9*b*).

When the base table 30 is further moved in the forward direction, the tip ends of the wiper blades 32M, 32C, and 32K located at the rubbing position contact the blade cleaner 33 and rub each other, and thereby ink adhered to the wiper blades 32M, 32C, and 32K is rubbed off. Accordingly, even if the ink having been splashed when the wiper blade 32C, which had been used for wiping, separated from the nozzle formed surface 10*a* is adhered to the adjacent wiper blades 32M and 32K, the blade cleaner 33 can clean the wiper blades 32M, 32C, and 32K together. Thus, problems that would contaminate the nozzle formed surfaces 10*a* at the next wiping operation are prevented, and thereby the cleaning performance can be maintained.

Thereafter, the control section moves the base table 30 in the forward direction. When the shielding plate 38 comes to the home position detection sensor 34, the control section 6 stops the motion of the base table 30 in the forward direction. At this moment, the control section 6 stops applying current to the solenoids 326 corresponding to the wiper blades 32M, 32C, and 32K, and completes the maintenance operation. Thus, the wiper blades 32M, 32C, and 32K incline down to the retreating position due to the pulling force of the tension springs 325 (FIG. 4).

Since the inclining-down operation of wiper blades 32 upon releasing of current application to the solenoids 326 is done swiftly in an instant by the pulling force of the respective tension springs 325, the residual ink can be flicked and thus removed even if ink, which could not be removed by the blade cleaner 33, is remaining on the surface of the wiper blades 32.

Further, after the maintenance operation is completed, all the wiper blades 32 are at the retreating position and the wiper blades 32 are inclined down. Accordingly, even if ink is still remaining at the tip end surface of the wiper blade 32, this ink can flow down off a wiper blade 32. Herein, it is only necessary to rotate the wiper blades to move them into the inclined state, which can be achieved by a simple moving mechanism.

Still further, after the maintenance operation is completed, as the wiper blades 32 are at the retreating position where they are always inclined down by the tension springs 325, it is impossible that a wiper blade 32 and a recording head 10 unexpectedly interfere with each other. Particularly, the wiper blades 32 are at the retreating position when no current is applied to the solenoids 326. Accordingly, even when a failure has occurred on the maintenance section 3, a defect of a solenoid 326 for example, a wipe blade 32 and the corresponding recording head 10 do not interfere with each other, which prevents damaging of the wiper blade 32.

In the foregoing description, only the wiper blade 32C having been used for wiping and the wiper blades 32M and 32K neighboring the wiper blade 32C, out of the four wiper blades 32, are set at the rubbing position during cleaning by the blade cleaner 33. However, the invention is not limited thereto. For example, in a case where a number of wiper blades are provided corresponding to a number of recording heads, more than three wiper blades including a wiper blade having been used for wiping and the wiper blades neighboring it may be set at the retreating position to be cleaned by the blade cleaner 33 after the wiping operation. Of course, more preferably in the present invention, all the wiper blades 32 may be set at the retreating position to be cleaned by the blade cleaner 33.

Further, although a most preferable example in which a wiping blade is inclined down from a rubbing position to a retreating position has been described as a moving mechanism of the wiper blade 32, a wiper blade 32 may be lowered from a rubbing position down to a retreating position, for example.

Although an inkjet printer has been described as an example in the present embodiment, the invention is not limited thereto. The invention can be widely applied to liquid ejection apparatuses having a liquid ejection head that ejects liquid from a nozzle/nozzles, such as an electrode forming apparatus that forms an electrode by ejecting a liquid electrode material onto a substrate, a biochip manufacturing apparatus that manufactures a biochip by ejecting living specimen, a micro pipette that ejects a sample in a predetermined amount into a reservoir, and the like.

What is claimed is:

1. A liquid ejection apparatus, comprising:

a plurality of liquid ejection heads each of which ejects a liquid droplet from a nozzle;

a plurality of elastic wiper blades each of which contacts a nozzle formed surface of the corresponding liquid ejection head and moves in substantially parallel and relatively to the nozzle formed surface of the liquid ejection head so as to rub the nozzle formed surface;

a blade cleaner for removing liquid adhered to the wiper blades;

a cleaning unit for removing liquid adhered to the wiper blades by relatively moving the wiper blades and blade cleaner to be rubbed with each other;

a wiper blade moving unit for respectively and independently moving the plurality of wiper blades between a rubbing position where the wiper blades can rub the nozzle formed surfaces of the respective liquid ejection heads and a retreating position where the wiper blades do not contact the respective liquid ejection heads; and a control unit that controls the wiper blade moving unit such that, after the control unit has moved a wiper blade selecting from the plurality of wiper blades to the rubbing position and rubbed the nozzle formed surface of the corresponding liquid ejection head with the wiper blade, the control unit moves at least one other wiper blade in addition to the selected wiper blade, to the rubbing position so that the cleaning unit can make the blade cleaner and the moved wiper blades rub with each other.

2. The liquid ejection apparatus of claim 1, wherein the wiper blade moving unit comprises:

first moving units for moving the respective wiper blades to the rubbing position; and second moving units for moving the respective wiper blades to the retreating position;

and wherein the second moving units independently move the respective wiper blades to the retreating position when wiping is not performed with the respective wiper blades.

3. The liquid ejection apparatus of claim 2, wherein each first moving unit comprises a solenoid;

wherein each second moving unit comprises a tension spring;

and wherein current is not applied to the solenoid when wiping is not performed so that a pulling force of the tension spring sets the wiper blade at the retreating position.

4. The liquid ejection apparatus of claim 1, wherein the wiper blade moving unit inclines the plurality of wiper blades so as to move the wiper blades from the rubbing position to the retreating position where the wiper blades do not contact the liquid ejection heads.

5. The liquid ejection apparatus of claim 1, wherein the wiper blade moving unit comprises a restricting unit that restricts the wiper blades to incline in the same direction as the direction of rubbing the respective nozzle formed surfaces when the wiper moving unit is to move the wiper blades to the retreating position, and restricts the wiper blades to incline in a direction opposite to the direction of rubbing the respective nozzle formed surfaces when the nozzle formed surfaces are to be rubbed with the wiper blades.

6. The liquid ejection apparatus of claim 1, wherein the cleaning unit relatively and reciprocally moves the wiper blades and blade cleaner.

7. The liquid ejection apparatus of claim 1, wherein the control unit moves at least one wiper blade neighboring the selected wiper blade in addition to the selected wiper blade, to the rubbing position.

8. A maintenance method of liquid ejection heads of a liquid ejection apparatus having a plurality of liquid ejection heads, a plurality of corresponding elastic wiper blades, and a wiper cleaner for cleaning the wiper blades, comprising the steps of:

moving a first wiper blade of which a corresponding liquid ejection head having ejected a liquid droplet from a nozzle with a selection from the plurality of wiper blades, from a retreating position where the wiper blades do not contact nozzle formed surfaces of the corresponding liquid ejection heads to a rubbing position where the wiper blades can rub the nozzle formed surfaces, thereby making the first wiper blade contact the nozzle formed surface, and moving the first wiper blade in substantially parallel and relatively to the nozzle formed surface so as to rub the nozzle formed surface with the first wiper blade;

independently moving at least one wiper blade other than the first selected wiper blade of the plurality of wiper blades from the retreating position to the rubbing position, after the rubbing of the nozzle formed surface of the liquid ejection head with the first selected wiper blade; and removing liquid adhered to the wiper blades having been moved to the rubbing position, by relatively moving the wiper blades and the blade cleaner to be rubbed with each other.

9. The maintenance method of liquid ejection heads of claim 8, wherein the liquid ejection apparatus includes first moving units for moving the respective wiper blades to the rubbing position and second moving units for moving the respective wiper blades to the retreating position;

and wherein the second moving units independently move the respective wiper blades to the retreating position when wiping is not performed with the respective wiping blades.

10. The maintenance method of liquid ejection heads of claim 9, wherein each first moving unit includes a solenoid, and each second moving unit includes a tension spring;

and wherein current is not applied to the solenoid when wiping is not performed so that a pulling force of the tension spring sets the wiper blade at the retreating position.

11. The maintenance method of liquid ejection heads of claim 8, wherein the wiper blade moving unit inclines the plurality of wiper blades so at to move the wiper blades from the rubbing position to the retreating position where the wiper blades do not contact the liquid ejection heads.

12. The maintenance method of liquid ejection heads of claim 8, wherein the method restricts the wiper blades to incline in the same direction as the direction of rubbing the respective nozzle formed surfaces when the wiper blades are to be moved to the retreating position, and restricts the wiper blades to incline in a direction opposite to the direction of rubbing the respective nozzle formed surfaces when the nozzle formed surfaces are to be rubbed with the wiper blades.

13. The maintenance method of liquid ejection heads of claim 8, wherein the wiper blades and the blade cleaner are moved relatively and reciprocally.

14. The maintenance method of liquid ejection heads of claim 8, wherein at least one wiper blade neighboring the selected first wiper blade is moved to the rubbing position in the independently moving step.

* * * * *